US008047374B1

(12) United States Patent
Heinzler et al.

(10) Patent No.: US 8,047,374 B1
(45) Date of Patent: Nov. 1, 2011

(54) MEDICATION CADDY SYSTEM

(76) Inventors: Robert G. Heinzler, Palm Harbor, FL (US); John F. Lovely, Palm Harbor, FL (US)

( * ) Notice: Subject to any disclaimer, the term of this patent is extended or adjusted under 35 U.S.C. 154(b) by 0 days.

(21) Appl. No.: 12/590,723

(22) Filed: Nov. 13, 2009

(51) Int. Cl.
*B65D 69/00* (2006.01)

(52) U.S. Cl. ..... 206/570; 206/538; 206/561; 206/828

(58) Field of Classification Search ..... 206/232, 206/561, 538, 537, 372, 373, 426, 767, 278, 206/570, 828; 220/545, 533, 532, 530, 529, 220/534
See application file for complete search history.

(56) References Cited

U.S. PATENT DOCUMENTS

| | | | | | |
|---|---|---|---|---|---|
| 1,236,085 | A | * | 8/1917 | Hudnut | 206/560 |
| 1,642,161 | A | * | 9/1927 | Lester | 224/543 |
| 1,680,668 | A | * | 8/1928 | De Boer | 220/23.87 |
| 1,739,730 | A | * | 12/1929 | Orthwine | 211/128.1 |
| 1,916,238 | A | * | 7/1933 | Soffel | 206/561 |
| 2,101,492 | A | * | 12/1937 | Cogswell | 206/747 |
| 2,661,858 | A | * | 12/1953 | Howell | 15/257.06 |
| 3,581,906 | A | * | 6/1971 | Joyce | 211/126.5 |
| 3,842,976 | A | * | 10/1974 | Dea | 206/203 |
| 4,100,684 | A | * | 7/1978 | Berger | 434/417 |
| 4,667,822 | A | * | 5/1987 | Coopmans | 206/373 |
| 4,807,760 | A | * | 2/1989 | Sussman | 206/581 |
| 5,344,004 | A | * | 9/1994 | Meyer | 206/45.25 |
| D383,633 | S | * | 9/1997 | Schweitzer | D6/567 |
| 6,619,482 | B1 | * | 9/2003 | King | 206/747 |
| 7,044,424 | B2 | * | 5/2006 | Robertson et al. | 248/311.2 |
| 2007/0267551 | A1 | * | 11/2007 | Townsend | 248/125.8 |

* cited by examiner

*Primary Examiner* — Mickey Yu
*Assistant Examiner* — Jenine Pagan

(57) ABSTRACT

A back support has front, rear, bottom, top and side edges. A box has a rear face formed coextensive with the back support, a front face, a bottom face, and side faces. A rectilinear chamber is formed by the front, rear, bottom and side faces of the box and has an open top for receiving and supporting medication containers on the bottom face of the box for easy access and removal. The chamber is formed with vertically oriented recesses on the front and rear faces of the box. A plurality of rectangular divider panels with edges removably received within the recesses divide the chamber into sections adapted to separate the containers received and supported in the chamber. The panels are repositionable as a function of the size and number of the containers within the chamber.

1 Claim, 4 Drawing Sheets

FIG 1
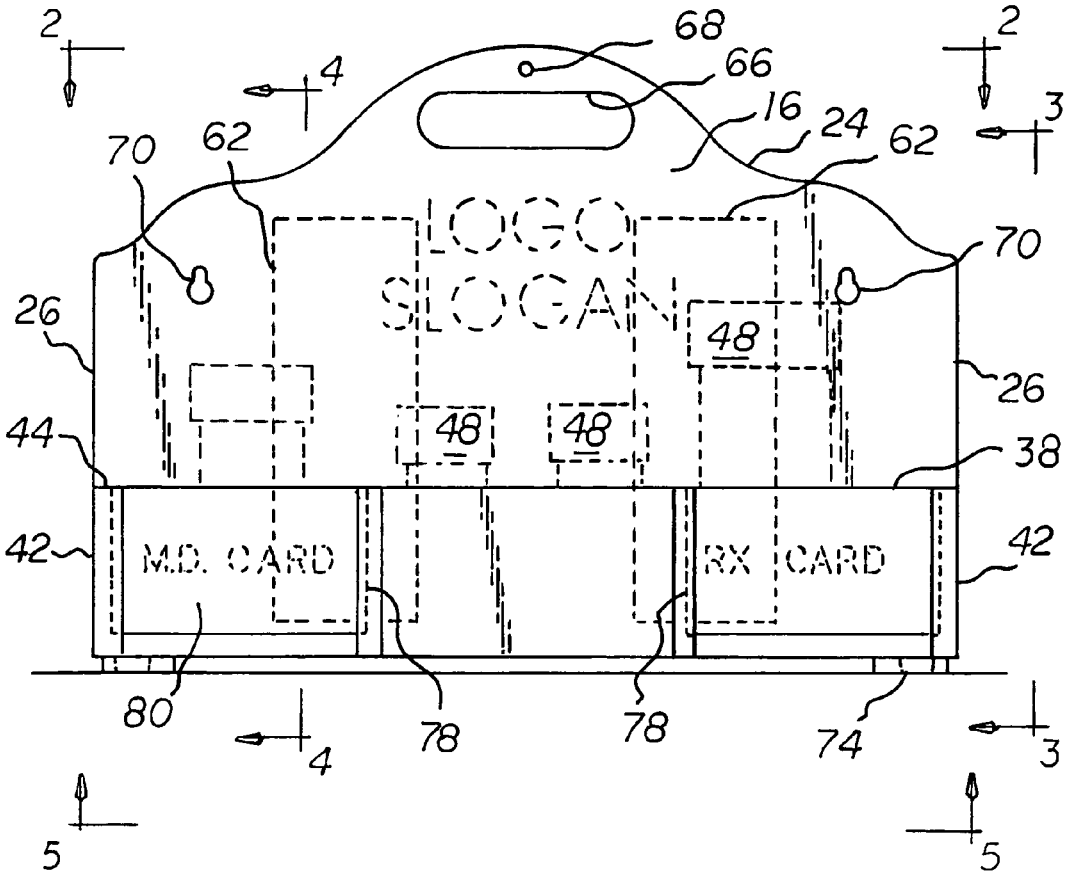
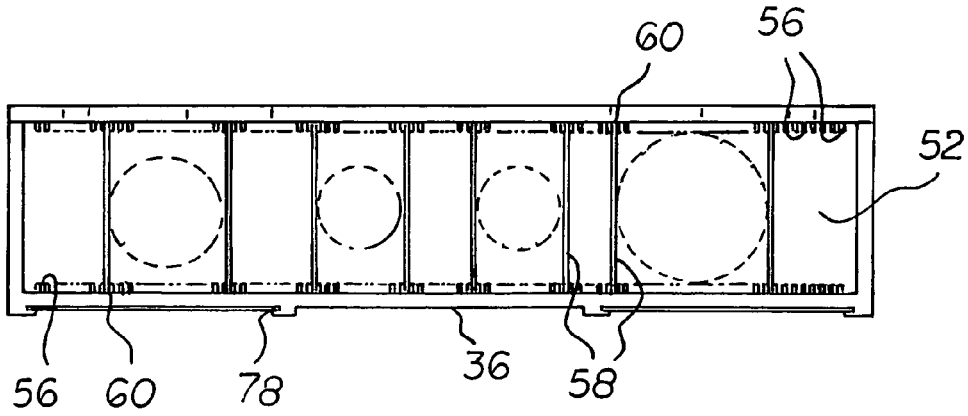
FIG 2

FIG 5
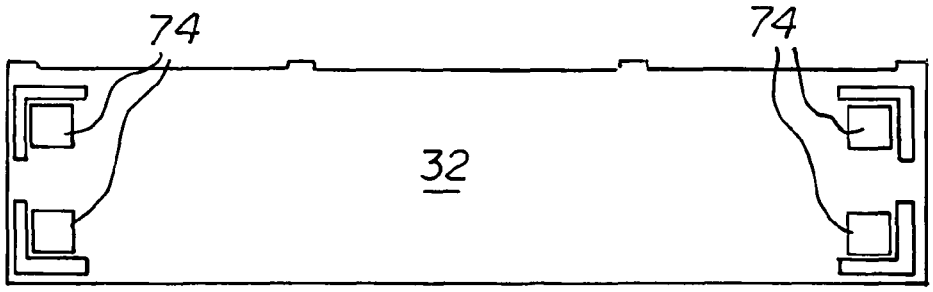
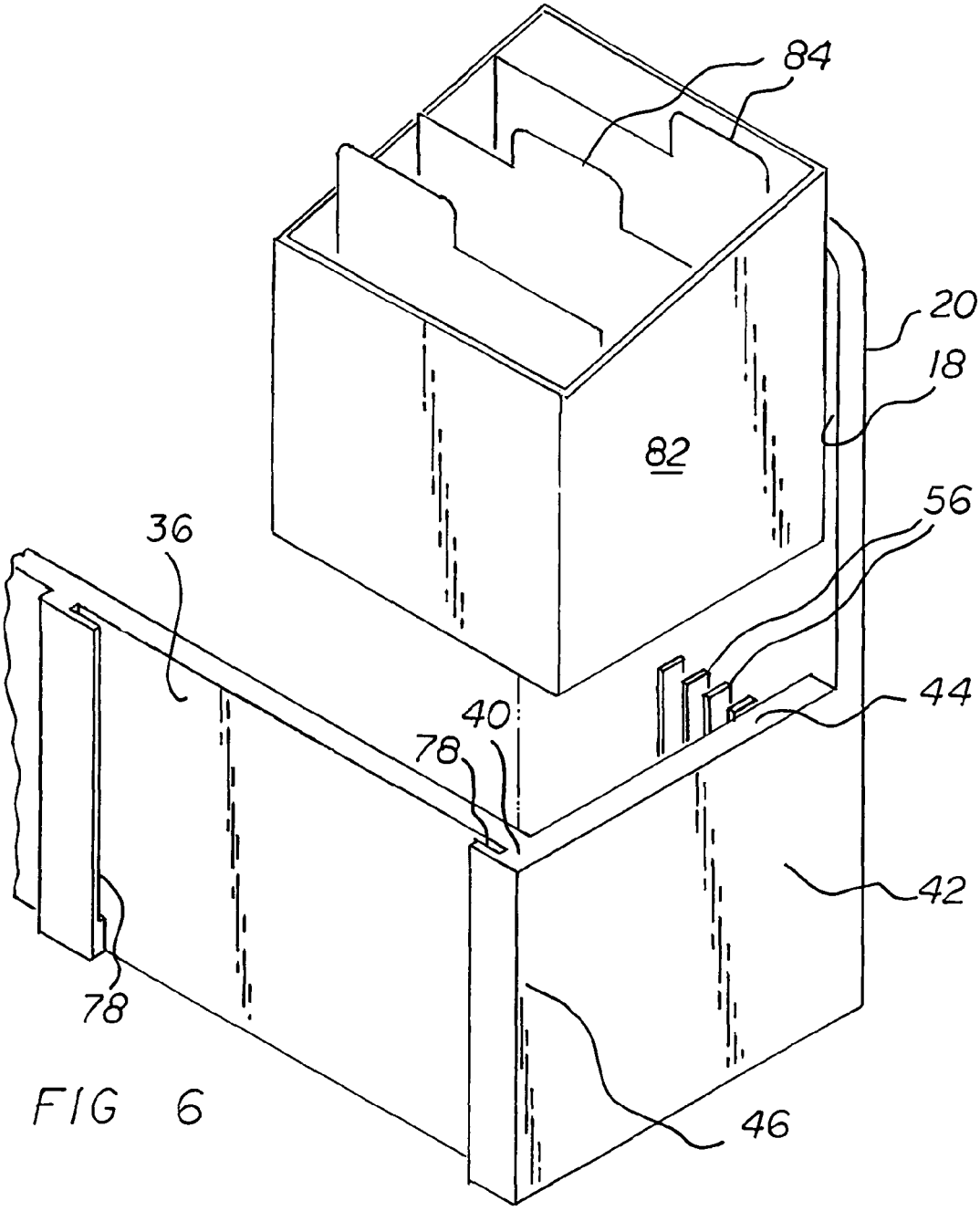
FIG 6

FIG 7
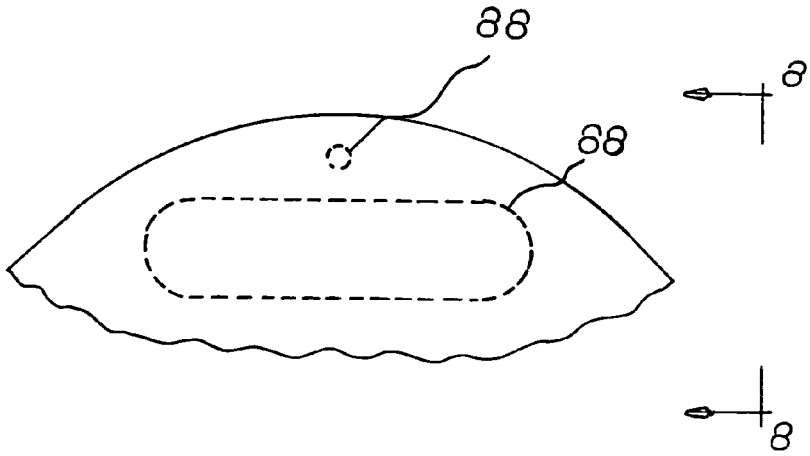
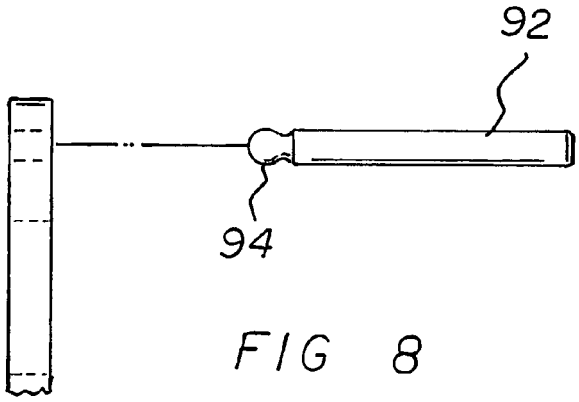
FIG 8
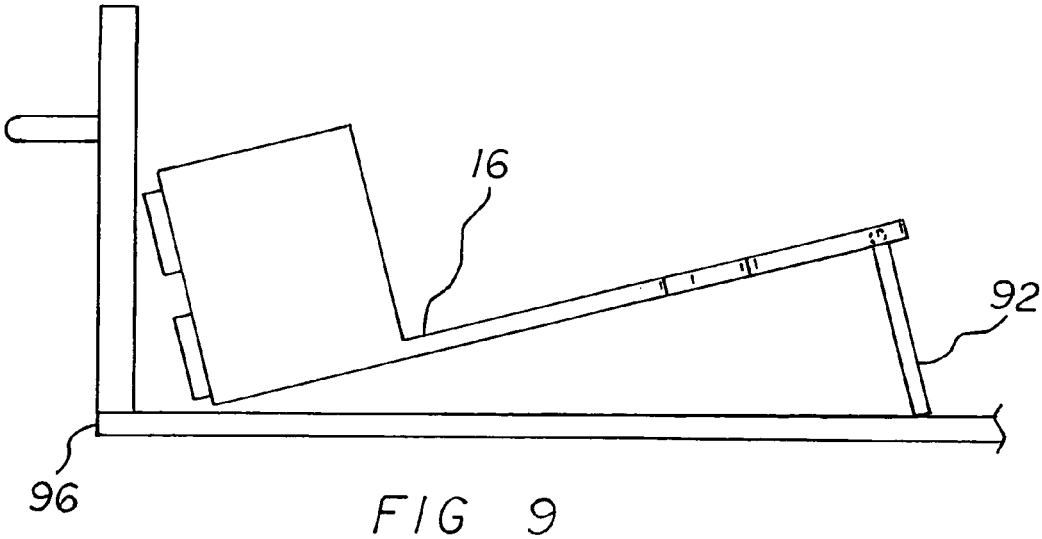
FIG 9

MEDICATION CADDY SYSTEM

BACKGROUND OF THE INVENTION

1. Field of the Invention

The present invention relates to a medication caddy system and more particularly pertains to receiving and storing medication containers in a safe, convenient and economical manner and for displaying the containers for easy identification and transportation purposes.

2. Description of the Prior Art

The use of medication caddies of known designs and configurations is known in the prior art. More specifically, medication caddies of known designs and configurations previously devised and utilized for the purpose of storing medications are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a medication caddy system that allows receiving and storing medication containers in a safe, convenient and economical manner and displaying the containers for easy identification and transportation purposes.

In this respect, the medication caddy system according to the present invention substantially departs from the conventional concepts and designs of the prior art, and in doing so provides an apparatus primarily developed for the purpose of receiving and storing medication containers in a safe, convenient and economical manner and for displaying the containers for easy identification and transportation purposes.

Therefore, it can be appreciated that there exists a continuing need for a new and improved medication caddy system which can be used for receiving and storing medication containers in a safe, convenient and economical manner and for displaying the containers for easy identification and transportation purposes. In this regard, the present invention substantially fulfills this need.

SUMMARY OF THE INVENTION

In view of the foregoing disadvantages inherent in the known types of medication caddies of known designs and configurations now present in the prior art, the present invention provides an improved medication caddy system. As such, the general purpose of the present invention, which will be described subsequently in greater detail, is to provide a new and improved medication caddy system and method which has all the advantages of the prior art and none of the disadvantages.

To attain this, the present invention essentially comprises a medication caddy having a vertical back support in a planar configuration. The back support has a front surface and a rear surface. The back support has a linear bottom edge and a contoured top edge spaced by a height of between 10 and 15 inches. The back support has linear side edges 26 spaced by a width of between 3 and 3.5 inches.

A rectilinear box has a rear face formed coextensively with the back support adjacent to the bottom edge of the back support. The box has a bottom face extending forwardly from the back support adjacent to the bottom edge. The bottom face has a front edge spaced from the bottom edge of the back support by a depth of between 3 and 4 inches. The box has a front face extending upwardly from the bottom face adjacent to the front edge of the bottom face. The front face has a top edge and side edges and an elevation of between 3 and 4 inches. The box has parallel side faces extending forwardly from the back support in proximity to the bottom edge. The side faces have top edges essentially coextensive with the top edge of the front face. The side faces have forward edges essentially coextensive with the side edges of the front face.

Next provided is a plurality of medication containers. The medication containers are variously sized and cylindrically shaped. The medication containers have side walls formed as a right circular cylinder, a rectangular cross section, a conical section, or the like.

A rectilinear chamber is next provided. The chamber is formed by the rear, front, bottom and side faces of the box. The chamber has an open top for receiving and supporting the medication containers on the bottom face of the box for easy access and removal. The chamber is formed with vertically oriented recesses on the front and rear faces of the box extending for the entire space between the side faces. A plurality of rectangular divider panels with edges are removably received within the recesses to divide the chamber into sections. The sections are adapted to separate the containers received and supported in the chamber. The panels are repositionable as a function of the size and number of the containers within the chamber.

Next, a pair of vertically extending, laterally spaced magnets are provided. The magnets are adhesively secured to the rear surface of the back support. The magnets are adapted to removably couple the box and supported containers to a magnetically responsive surface. The magnetically responsive surface is a refrigerator in the preferred embodiment.

A plurality of apertures is next provided. The apertures extend through the back support. The apertures include a generally oval hand opening to assist in carrying the box and supported containers. The hand opening is centrally located adjacent to the top edge of the back support above the magnets. The apertures also include a support hole 68 centrally located between the hand opening and the top edge of the back support. The apertures also include two screw holes laterally spaced outwardly of the magnets and elevationally between the chamber and the hand opening for hanging on a wall or cabinet door.

Next provided are soft tabs. The soft tabs extend downwardly from the bottom face of the box. The soft tabs function to facilitate safe positioning of the system on a horizontal recipient surface.

Pairs of edge receivers are next provided. The edge receivers are formed in the front face of the box. The edge receivers are adapted to removably receive business cards and other written data for ready viewing.

Next, a file organizer is provided. The file organizer has tabbed divider sheets. The file organizer is adapted to receive sheet material related to medication in the containers and other health-related matters.

Knock out panels are next provided. The knock out panels are formed in the apertures of the back support. The knock out panels are formed during fabrication and are adapted to be removed prior to using the system.

Lastly, a support post is provided. The support has a spherical head. The support post is adapted to be removably positioned in the support hole for supporting the back support and the containers at a convenient orientation within a drawer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved medication caddy system which has all of the advantages of the prior art medication caddies of known designs and configurations and none of the disadvantages.

It is another object of the present invention to provide a new and improved medication caddy system which may be easily and efficiently manufactured and marketed.

It is further object of the present invention to provide a new and improved medication caddy system which is of durable and reliable constructions.

An even further object of the present invention is to provide a new and improved medication caddy system which is susceptible of a low cost of manufacture with regard to both materials and labor, and which accordingly is then susceptible of low prices of sale to the consuming public, thereby making such medication caddy system economically available to the buying public.

Even still another object of the present invention is to provide a medication caddy system for receiving and storing medication containers in a safe, convenient and economical manner and for displaying the containers for easy identification and transportation purposes.

Lastly, it is an object of the present invention to provide a new and improved back support having front, rear, bottom, top and side edges. A box has a rear face formed coextensive with the back support, a front face, a bottom face, and side faces. A rectilinear chamber is formed by the front, rear, bottom and side faces of the box and has an open top for receiving and supporting medication containers on the bottom face of the box for easy access and removal. The chamber is formed with vertically oriented recesses on the front and rear faces of the box. A plurality of rectangular divider panels with edges removably received within the recesses divide the chamber into sections adapted to separate the containers received and supported in the chamber. The panels are repositionable as a function of the size and number of the containers within the chamber.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a medication caddy system constructed in accordance with the principles of the present invention.

FIG. 2 is a plan view of the medication caddy system taken along line 2-2 of FIG. 1.

FIG. 5 is a bottom view of the medication caddy system taken along line 5-5 of FIG. 1.

FIG. 6 is an exploded perspective illustration of a portion of an optional component of the system.

FIG. 7 is front elevational view of a portion of another optional component of the system.

FIG. 8 is a side elevational view of the medication caddy system taken along line 8-8 of FIG. 7.

FIG. 9 is a side elevational view of the medication caddy system positioned within a drawer.

The same reference numerals refer to the same parts throughout the various Figures.

DESCRIPTION OF THE PREFERRED EMBODIMENT

Figure 3:
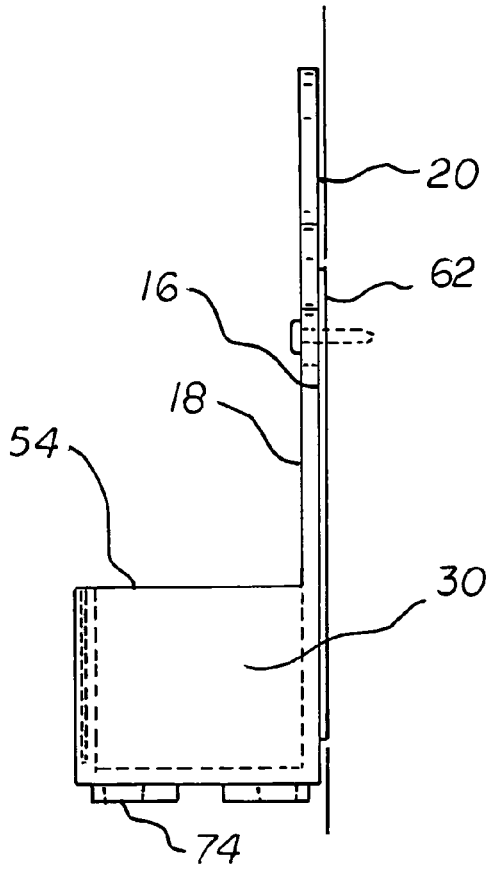
FIG. 3 is a side elevational view of the medication caddy system taken along line 3-3 of FIG. 1.
Figure 4:
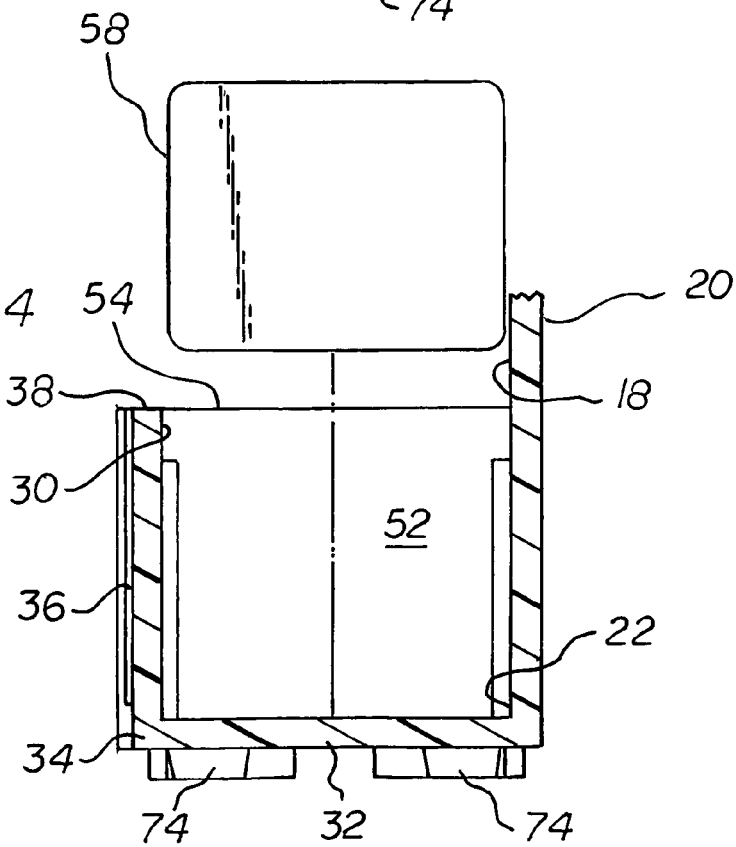
FIG. 4 is a cross sectional view of the medication caddy system taken along line 4-4 of FIG. 1.

With reference now to the drawings, and in particular to FIG. 1 thereof, the preferred embodiment of the new and improved medication caddy system embodying the principles and concepts of the present invention and generally designated by the reference numeral 10 will be described.

The present invention, the medication caddy system 10 is comprised of a plurality of components. Such components in their broadest context include a back support, a box, a rectilinear chamber and a plurality of rectangular divider panels. Such components are individually configured and correlated with respect to each other so as to attain the desired objective.

The medication caddy system 10 of the present invention is for receiving and storing medication containers in a safe, convenient and economical manner and for displaying the containers for easy identification and transportation purposes. First provided is a vertical back support 16 in a planar configuration. The back support has a front surface 18 and a rear surface 20. The back support has a linear bottom edge 22 and a contoured top edge 24 spaced by a height of between 10 and 15 inches. The back support has linear side edges 26 spaced by a width of between 3 and 3.5 inches.

A rectilinear box 30 has a rear face formed coextensively with the back support adjacent to the bottom edge of the back support. The box has a bottom face 32 extending forwardly from the back support adjacent to the bottom edge. The bottom face has a front edge 34 spaced from the bottom edge of the back support by a depth of between 3 and 4 inches. The box has a front face 36 extending upwardly from the bottom face adjacent to the front edge of the bottom face. The front face has a top edge 38 and side edges 40 and an elevation of between 3 and 4 inches. The box has parallel side faces 42 extending forwardly from the back support in proximity to the bottom edge. The side faces have top edges 44 essentially coextensive with the top edge of the front face. The side faces have forward edges essentially coextensive with the side edges of the front face.

Next provided is a plurality of medication containers 48. The medication containers are variously sized and cylindrically shaped. The medication containers have side walls formed as a right circular cylinder, a rectangular cross section, a conical section, or the like.

A rectilinear chamber 52 is next provided. The chamber is formed by the rear, front, bottom and side faces of the box. The chamber has an open top 54 for receiving and supporting the medication containers on the bottom face of the box for easy access and removal. The chamber is formed with vertically oriented recesses 56 on the front and rear faces of the box extending for the entire space between the side faces. A plurality of rectangular divider panels 58 with edges 60 are removably received within the recesses to divide the chamber into sections. The sections are adapted to separate the containers received and supported in the chamber. The panels are repositionable as a function of the size and number of the containers within the chamber.

Next, a pair of vertically extending, laterally spaced magnets 62 are provided. The magnets are adhesively secured to the rear surface of the back support. The magnets are adapted to removably couple the box and supported containers to a magnetically responsive surface. The magnetically responsive surface is a refrigerator in the preferred embodiment.

A plurality of apertures is next provided. The apertures extend through the back support. The apertures include a generally oval hand opening 66 to assist in carrying the box and supported containers. The hand opening is centrally located adjacent to the top edge of the back support above the magnets. The apertures also include a support hole 68 centrally located between the hand opening and the top edge of the back support. The apertures also include two screw holes 70 laterally spaced outwardly of the magnets and elevationally between the chamber and the hand opening for hanging on a wall or cabinet door.

Next provided are soft tabs 74. The soft tabs extend downwardly from the bottom face of the box. The soft tabs function to facilitate safe positioning of the system on a horizontal recipient surface.

Pairs of edge receivers 78 are next provided. The edge receivers are formed in the front face of the box. The edge receivers are adapted to removably receive business cards 80 and other written data for ready viewing.

Next, a file organizer 82 is provided. The file organizer has tabbed divider sheets 84. The file organizer is adapted to receive sheet material related to medication in the containers and other health-related matters.

Knock out panels 88 are next provided. The knock out panels are formed in the apertures of the back support. The knock out panels are formed during fabrication and are adapted to be removed prior to using the system.

Lastly, a support post 92 is provided. The support has a spherical head 94. The support post is adapted to be removably positioned in the support hole for supporting the back support and the containers at a convenient orientation within a drawer 96.

The medication caddy of the present invention can be hung on a refrigerator or other magnetically responsive surface. The refrigerator is the first most common place for emergency medical personnel to look for such medication and medication information. The caddy can be placed on a kitchen counter top, bedroom dresser, night table, or other horizontal surface and will be held steady by the soft tabs, or footpads, on the bottom of the caddy. The caddy can be hung on a wall, cabinet door, or other vertical surface by using the screw and/or support holes on the back of the caddy. The caddy can be placed in a kitchen drawing using the post on the back to position at a convenient angle.

The medication caddy of the present invention can be used for both prescription drugs and over the counter medications. The material of manufacture of the caddy may be plastic, metal, ceramics, or any other suitable material. The file holder is used for emergency contact information, prescriptions, appointment cards, doctor's notes, and other medically related information and reminders.

The caddy of the present invention is easily transportable to various locations in the house and to be taken with a patient for doctor visits, emergency situations where a patient may be transported to a facility, pharmacy visits, and vacations. In this manner, all critical medical information is contained in one convenient location. Health care workers can check for potentially dangerous drug interactions and contraindications.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A medication caddy system for receiving and storing medication containers, and for displaying the containers for easy identification and transportation purposes, the system comprising, in combination:

a vertical back support in a planar configuration having a front surface and a rear surface, the back support having a linear bottom edge and a contoured top edge spaced by a height of between 10 and 15 inches, the back support having linear side edges spaced by a width of between 3 and 3.5 inches;

a rectilinear box having a rear face formed coextensively with the back support adjacent to the bottom edge of the back support, the box having a bottom face extending forwardly from the back support adjacent to the bottom edge, the bottom face having a front edge spaced from the bottom edge of the back support by a depth of between 3 and 4 inches, the box having a front face extending upwardly from the bottom face adjacent to the front edge of the bottom face, the front face having a top edge and side edges and an elevation of between 3 and 4 inches, the box having parallel side faces extending forwardly from the back support in proximity to the bottom edge, the side faces having top edges essentially coextensive with the top edge of the front face, the side faces having forward edges essentially coextensive with the side edges of the front face;

a plurality of variously sized, cylindrically shaped medication containers with side walls formed as a right circular cylinder, a rectangular cross section, a conical section, or the like;

a rectilinear chamber formed by the rear, front, bottom and side faces of the box, the chamber having an open top for receiving and supporting the medication containers on the bottom face of the box for easy access and removal, the chamber being formed with vertically oriented recesses on the front and rear faces of the box extending for the entire space between the side faces, a plurality of rectangular divider panels with edges removably received within the recesses to divide the chamber into sections adapted to separate the containers received and supported in the chamber, the panels being repositionable as a function of the size and number of the containers within the chamber;

a pair of vertically extending, laterally spaced magnets adhesively secured to the rear surface of the back support, the magnets adapted to removably couple the box and supported containers to a refrigerator;

a plurality of apertures extending through the back support, the apertures including a generally oval hand opening to assist in carrying the box and supported containers, the hand opening being centrally located adjacent to the top edge of the back support above the magnets, the apertures including two screw holes laterally spaced outwardly of the magnets and elevationally between the chamber and the hand opening for hanging on a wall or cabinet door;

soft tabs extending downwardly from the bottom face of the box to facilitate safe positioning of the system on a horizontal recipient surface;

pairs of edge receivers formed in the front face of the box, the edge receivers adapted to removably receive business cards and other written data for ready viewing;

a file organizer with tabbed divider sheets adapted to receive sheet material related to medication in the containers and other health-related matters; and knock out panels formed in the apertures of the back support, the knock out panels being formed during fabrication and adapted to be removed prior to use.

* * * * *